US009689129B2

(12) United States Patent
Kelly

(10) Patent No.: US 9,689,129 B2
(45) Date of Patent: Jun. 27, 2017

(54) SELF-ACTIVATING FLOOD PROTECTION BARRIER

(71) Applicant: Bluewater Design Associates Limited, Droitwich Worcestershire (GB)

(72) Inventor: Frank Kelly, Droitwich (GB)

(73) Assignee: Bluewater Design Associates Limited, Droitwich Worcestershire (GB)

( * ) Notice: Subject to any disclaimer, the term of this patent is extended or adjusted under 35 U.S.C. 154(b) by 0 days.

(21) Appl. No.: 15/230,453

(22) PCT Filed: Feb. 10, 2015

(86) PCT No.: PCT/EP2015/052708

§ 371 (c)(1),
(2) Date: Aug. 7, 2016

(87) PCT Pub. No.: WO2015/121229

PCT Pub. Date: Aug. 20, 2015

(65) Prior Publication Data

US 2016/0369469 A1 Dec. 22, 2016

(30) Foreign Application Priority Data

Feb. 13, 2014 (GB) ..... 1402555.5

(51) Int. Cl.
*E02B 3/10* (2006.01)
*E02B 7/26* (2006.01)
(Continued)

(52) U.S. Cl.
CPC ..... *E02B 3/104* (2013.01); *E02B 7/205* (2013.01); *E02B 7/26* (2013.01); *E02B 7/44* (2013.01); *E02B 7/50* (2013.01); *E02B 7/54* (2013.01)

(58) Field of Classification Search
CPC ..... E02B 3/104; E02B 7/44; E02B 7/54
(Continued)

(56) References Cited

U.S. PATENT DOCUMENTS 5,725,326 A * 3/1998 Van den Noort ..... E02B 3/104 405/103
6,338,594 B1 * 1/2002 Adler ..... B82Y 10/00 405/104
(Continued)

FOREIGN PATENT DOCUMENTS

BE 1007129 4/1995
DE 20300565 3/2003
(Continued)

OTHER PUBLICATIONS

The PCT International Search Report Application No. PCT/EP2015/052708 mailed Apr. 29, 2015.
(Continued)

*Primary Examiner* — Benjamin Fiorello

(57) ABSTRACT

A self-activating flood barrier includes a chamber (1) having first and second side walls (3, 5), a dam member (9) adapted to self-deploy in the event of a flood to inhibit the passage of water to a region to be protected, and a low-friction device (77, 79) positioned between the dam member and at least one of the first and second side walls of the chamber when the dam member is deployed. The low-friction device prevents jamming between the dam member and the at least one side wall.

19 Claims, 10 Drawing Sheets

(51) Int. Cl.

| | |
|---|---|
| ***E02B 7/54*** | (2006.01) |
| ***E02B 7/20*** | (2006.01) |
| ***E02B 7/50*** | (2006.01) |
| ***E02B 7/44*** | (2006.01) |

(58) Field of Classification Search
USPC ..... 405/111
See application file for complete search history.

(56) References Cited

U.S. PATENT DOCUMENTS

| | | | | |
|---|---|---|---|---|
| 9,453,315 | B2 * | 9/2016 | Roy | E02B 3/104 |
| 2009/0169302 | A1 * | 7/2009 | Alpern | E02B 3/104 405/33 |
| 2011/0110722 | A1 * | 5/2011 | van Den Noort | E02B 3/104 405/87 |
| 2011/0268506 | A1 * | 11/2011 | Thornbury | E02B 3/104 405/118 |
| 2012/0134750 | A1 * | 5/2012 | Fujita | E02B 7/205 405/111 |
| 2013/0028660 | A1 * | 1/2013 | Haq | E02B 3/104 405/31 |

FOREIGN PATENT DOCUMENTS

| | | |
|---|---|---|
| DE | 10201882 | 7/2003 |
| DE | 202012006100 | 9/2012 |
| EP | 1950352 | 7/2008 |
| EP | 2354326 | 8/2011 |
| GB | 2371584 | 7/2002 |
| GB | 2425559 | 11/2006 |
| GB | 2457463 | 8/2009 |
| GB | 2465346 | 5/2010 |
| JP | 2000345537 | 12/2000 |
| JP | 2001241261 | 9/2001 |
| WO | 00/01892 | 1/2000 |
| WO | 2009/139622 | 11/2009 |

OTHER PUBLICATIONS

The United Kingdom Search Report Application No. GB1402555.5 mailed Aug. 18, 2014.

* cited by examiner

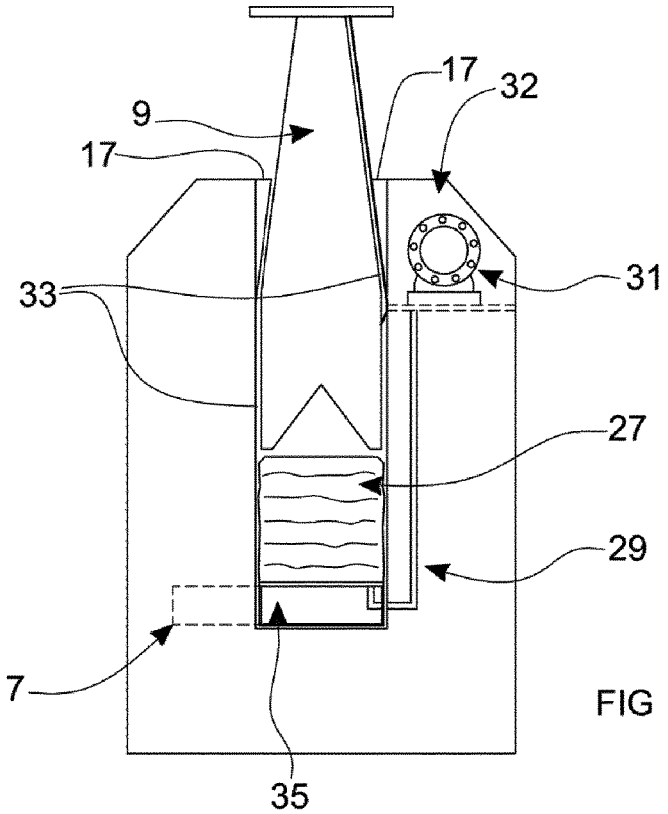
FIG 6
FIG 7
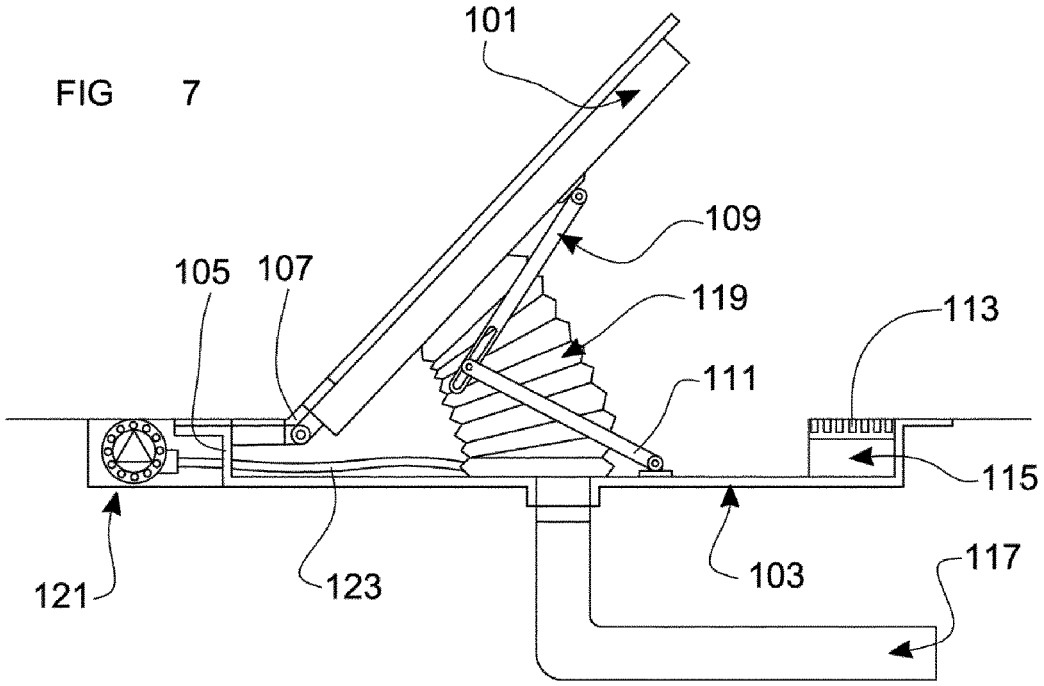

SELF-ACTIVATING FLOOD PROTECTION BARRIER

BACKGROUND

This application is a 371 of PCT/EP2015/052708, filed Feb. 10, 2015, which claims priority from application GB 1402555.5, filed Feb. 13, 2014. The entire contents of each of these applications are incorporated herein by reference.

TECHNICAL FIELD

This invention relates to a self-activating flood protection barrier and more particularly to a self-activating flood protection barrier provided with means for preventing jamming of a barrier member.

BACKGROUND OF RELATED ART

Self-activating flood barriers are known, for example, from WO2009/139622. The flood barrier disclosed in that document comprises a chamber having a first side wall, a second side wall and a water inlet. A single support block is arranged on the first side wall and a dam member is movable upwardly and downwardly in the chamber. The dam member comprises an upright retaining wall for preventing water flow into a hinterland, and a blocking element for limiting upward movement of the dam member, the blocking element having an inclined surface. The support block also has an inclined surface, against which the inclined surface of the blocking element acts in a closed state of the flood barrier. Due to the orientation of the inclined surface of the support block, the blocking element of the dam member is forced to move sideways and thus a lateral force is created which urges the dam member against one side of the chamber.

A self-activating flood barrier is also known from EP2354326. The flood barrier comprises a barrier element at least partly housed inside a positioning seating, open at the upper part and located below ground level and below a walking plane. The positioning seating is connected to an entrance section for water disposed on the opposite side of the of the barrier element to the place the barrier element has to protect. The barrier element is movable between a first position in which it is completely below the walking plane and a second position in which it progressively rises by floating due to the water which progressively fills the positioning seating.

There are several disadvantages associated with such known flood barriers. For example, there is no back-up system in the event the dam member or barrier element should jam, for example due to the pressure of the water on one face of the barrier such that the barrier does not lower as the flood water recedes. In addition, the barrier can only be raised in the event of a flood because it is the flood water alone that causes the dam member or barrier element to rise and this can make maintenance of the barrier difficult.

SUMMARY OF THE INVENTION

It is therefore an object of the present invention to provide a self-activating flood protection barrier which overcomes, or at least ameliorates the above disadvantages.

According to the present invention there is provided a self-activating flood barrier including a chamber having first and second side walls, a dam member adapted to self-deploy in the event of a flood to inhibit the passage of water to a region to be protected, and a low-friction device positioned between the dam member and at least one of the first and second side walls of the chamber when the dam member is deployed so as to prevent jamming between the dam member and the at least one side wall.

The low-friction device may comprise at least one roller. A plurality of rollers may be provided along the longitudinal direction of the dam member. The at least one roller may be rotatable about an axis extending in the longitudinal direction of the dam member.

Alternatively or additionally, the low-friction device may comprise a low-friction material. The low-friction material may comprise a low-friction coating. The low-friction coating may be applied to a plate attached to dam member. Alternatively, the low-friction material may be applied to the dam member. The low-friction material may extend in the longitudinal direction of the dam member.

The low-friction device may be arranged between that side of the dam member and the one of the first and second side walls of the chamber exposed to flood water.

At least one side wall of the dam member may be inclined such that the dam member is narrower in an upper region thereof compared with a lower region thereof and wherein a complementary inclined surface is provided on a support block positioned at an upper region of the corresponding side wall of the chamber so as to engage with the inclined side wall of the dam member when the dam member is deployed. The support block may include a pivoting component pivotably mounted to the side wall of the chamber. The pivoting component may be mounted by way of a hinge. The pivoting member may be separable from the remainder of the barrier. The barrier may include means for releasably securing the pivoting member against pivoting. The pivoting member may be hollow and the releasable securing means may be located within the pivoting member, the pivoting member being provided with at least one aperture for accessing the releasable securing means. The pivoting member may include a removable seal and cover plate for closing the at least one aperture. The pivoting member may be mounted on the side wall by way of an L-shaped bracket set into the side wall of the chamber. The L-shaped bracket may be provided with anchoring elements for anchoring the bracket to the side wall of the chamber. The L-shaped bracket may be provided with a depending lip to protect the surface of the side wall of the chamber.

The dam member may be provided in a lower region of that side of the dam member exposed to flood water is formed with a longitudinal protrusion to engage against the side wall of the chamber.

The barrier may include secondary means disposed beneath the dam member capable of deploying the dam member independent of any flood condition. The barrier may include sensor means to determine whether or not the dam member has self-deployed in the event of a flood and to deploy the secondary deployment means in the event the dam member has failed to self-deploy. The secondary deployment means may comprise at least one inflatable air bag disposed beneath the dam member. The at least one inflatable air bag may be supported on an inverted tray to allow debris to accumulate beneath the tray. The barrier may include a pump/compressor for passing air to/from the at least one inflatable air bag. The pump/compressor may be provided within a watertight chamber. The watertight chamber may be provided in use in an upper region of the barrier. The dam member may be provided with a recess in a lower surface thereof. The recess may be in the form of an inverted V or may be part-circular in cross-section.

BRIEF DESCRIPTION OF THE DRAWINGS

For a better understanding of the present invention and to show more clearly how it may be carried into effect reference will now be made, by way of example, to the accompanying drawings in which:

FIG. 6 is an end elevational view of the self-activating flood protection barrier of FIGS. 1 to 5, with the dam member of FIG. 3, in a supported configuration;

FIG. 7 is an elevational view of an alternative form of self-activating flood protection barrier according to the present invention;

DETAILED DESCRIPTION OF PREFERRED EMBODIMENTS

Figure 1:
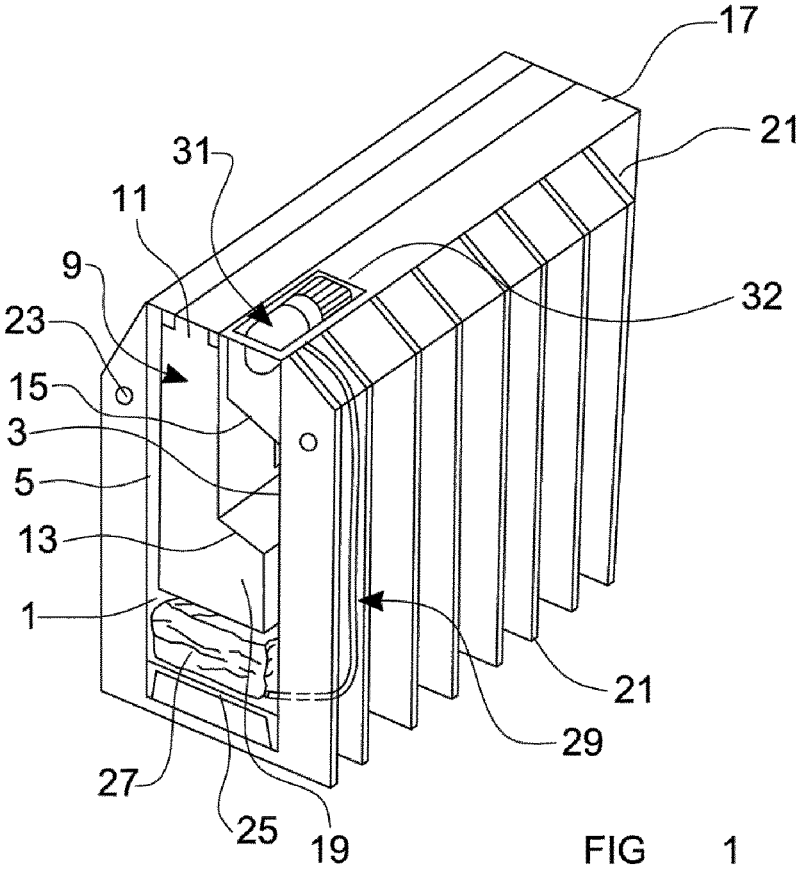
FIG. 1 is a perspective view of one embodiment of a self-activating flood protection barrier according to the present invention, the barrier being in a lowered configuration.

The self-activating flood protection barrier shown in FIGS. 1 to 6 is similar to that shown and described in WO2009/139622. That is a chamber 1 is formed between a first side wall 3, a second side wall 5 and an inlet/outlet 7 (see FIG. 6). A dam member 9 is arranged in the chamber 1 and is movable upwardly and downwardly dependent upon the level of water within the chamber 1. As shown, for example in FIGS. 1 and 3, the dam member may have a number of alternative configurations such as those corresponding to the dam members in WO2009/139622 (for example in FIG. 1 of the present application) and EP2354326 (for example in FIG. 3 of the present application), the two designs being functionally equivalent. The dam member includes an upright wall 11 for preventing flow of water into a region behind the barrier and at least one inclined surface 13 for engaging with at least one complementary inclined surface 15 formed in an upper region of the chamber and causing the width of the chamber to narrow such that the inclined surfaces of the dam member and chamber engage when the dam member is deployed.

Figure 4:
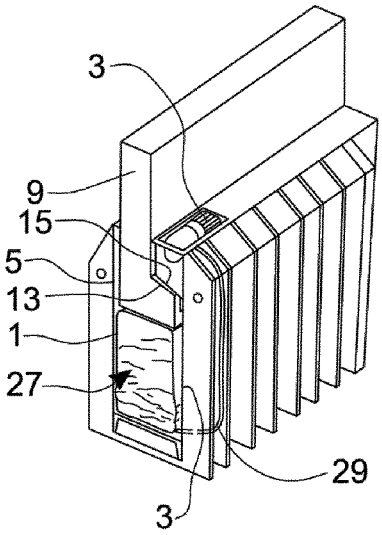
FIG. 4 is a perspective view corresponding to FIG. 1 of the self-activating flood protection barrier in a supported configuration.
Figure 5:
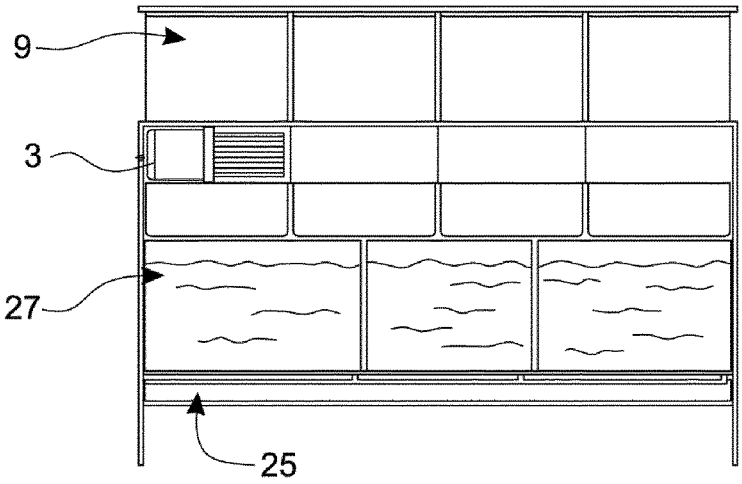
FIG. 5 is a front sectional view corresponding to FIG. 2 of the self-activating flood protection barrier in a supported configuration.

As shown in FIGS. 1 and 4, a single support block 17 is arranged on the first side wall 3 of the chamber 1 and has a single inclined surface 13, and dam member 9 is movable upwardly and downwardly in the chamber 1. The dam member 9 comprises upright retaining wall 11 for preventing water flow into a hinterland, and a blocking element 19 for limiting upward movement of the dam member, the blocking element having inclined surface 13. Due to the orientation of the inclined surface 15 of the support block 17 of the chamber 1, the blocking element 19 of the dam member 9 is forced to move sideways and thus a lateral force is created which urges the dam member 9 against the second side wall 5 of the chamber. In respect of FIG. 6, a support block 17 is provided on both side walls 3 and 5 to engage with inclined surfaces on both sides of the dam member 9.

The external faces of the chamber 1 are provided with reinforcing ribs 21 which both stiffen the chamber and facilitate securing the chamber in the ground. Endmost reinforcing ribs of a chamber are formed with apertures 23 (two such apertures being shown in FIGS. 1 and 4) to enable adjoining chambers to be secured together, for example with nuts and bolts, to form a longer barrier. It should be noted that alternative securing means may be provided, such as a threaded pin on one chamber and a corresponding aperture on an adjacent chamber to allow the chambers to be connected with nuts. A seal is arranged between the adjoining reinforcing ribs of attached chambers.

Figure 2:
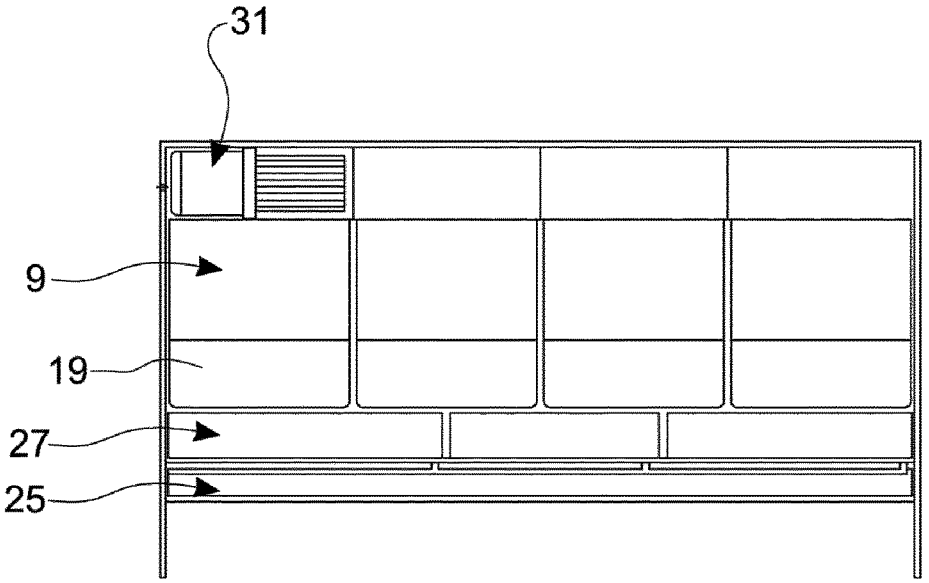
FIG. 2 is a front sectional view of the self-activating flood protection barrier shown in FIG. 1.

An inverted tray 25 is provided internally along the base of each chamber and allows debris or the like to pass through or around the tray and to collect at the bottom of the chamber where it is less likely to interfere with operation of the barrier. Services may also pass beneath the tray 25 if desired. A number of airbags 27 are positioned in the chamber between the inverted tray 25 and the dam member 9. An air transfer pipe 29 passes through a seal (not shown) in the side of the chamber to a (high pressure) pump/compressor 31 provided in a watertight chamber 32 at the top of the chamber 1, for example in one end of the support block 17 as shown in FIGS. 1 and 4 or between adjacent reinforcing ribs as shown in FIG. 6. Two adjoining reinforcing ribs may be provided with a cover (shown diagrammatically in FIG. 1) to protect the air transfer pipe 29. One or more access panels may be provided to allow access to the pump/compressor 31 and/or the air transfer pipe 29 for maintenance or other purposes. The pump/compressor 31 is operated by switch means (not shown), for example, by a manual switch or by a sensor which determines that the dam member needs to be moved. More than one airbag is preferred, for example three airbags for each chamber as illustrated in FIG. 2, because failure of one airbag will still permit the dam member to be raised or lowered using the remaining airbag(s), but a single airbag may be provided if desired. The airbags may be connected to the pump/compressor either individually or collectively. The pump/compressor is preferably connected to a supply of mains electricity, but in case of a power failure may additionally be connected to a generator and/or to a solar panel power supply and/or to a rechargeable battery (for example for use in remote locations).

Figure 3:
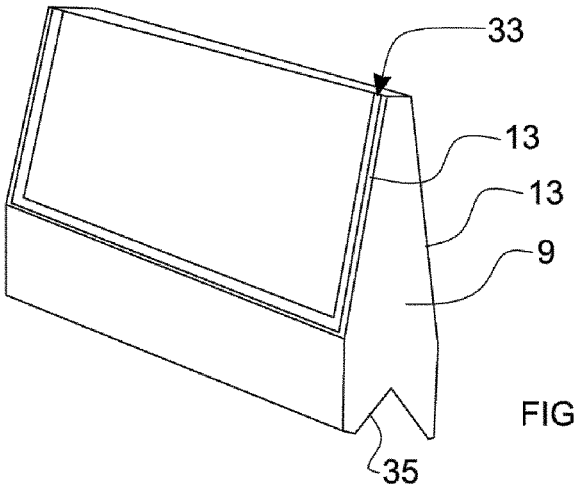
FIG. 3 is a perspective view of an alternative form of dam member for use in the self-activating flood protection barrier of FIGS. 1 and 2.

The dam member 9 having dual tapering walls 13 as shown in FIG. 3 is provided with a seal 33 on at least one of the tapering walls and which extends longitudinally of the dam member at the base of the wall and up towards the top of the dam member at each end of the tapering wall so as to form a continuous seal which engages with the complementary inclined surface 15 at least at one side of the chamber 1 to prevent the passage of flood water to the region behind the barrier.

The dam member shown in FIG. 3, and any other configuration of dam member according to the present invention, is optionally provided with a longitudinal recess 35, for example in the form of an inverted V as illustrated, but which may have alternative shapes such as part-circular in cross section. Any air that may enter the chamber 1 through the inlet/outlet 7 collects in the recess 35 instead of escaping between the chamber walls and the dam member and causing movement of the dam member which could result in leakage of water or jamming of the dam member as it rises. Any such air trapped in the recess 35 will assist in raising the dam member in times of flood, but will effectively escape when the flood recedes and water flows back out of the chamber 1.

In use of the barrier according to the present invention, when the barrier is not deployed the airbag(s) are in a collapsed configuration beneath the dam member 9 and resting on the tray 25. Any water within the chamber is able to drain past and/or through the tray and air is able to circulate around the chamber to keep the airbag(s) dry. The tray also allows debris, such as stones, which may cause damage, such as puncturing, to the airbag(s) to pass to the base of the chamber beneath the tray (and therefore the airbag(s)) to prolong the working life of the airbag(s). In the event of a flood the barrier will deploy as described in WO2009/139622 or EP2354326 to prevent the passage of flood water to a region to be protected. In the event the barrier becomes jammed and cannot self-activate, or in the case that the barrier needs to be deployed for maintenance or other purposes, the pump/compressor 31 is energised to inflate the airbag(s) and to cause the barrier to deploy by raising the dam member 9. One or more sensors may be provided to determine whether or not the barrier deploys in times of need and can either directly cause the airbag(s) to inflate in the absence of deployment or full deployment or, additionally or alternatively, can alert the owner or operator of the need to take action. The ability to raise the dam member 9 at times other than in flood conditions gives the operator or owner the satisfaction of knowing the barrier will deploy in times of need. The airbag(s) may in any event be used to augment deployment as a result of flood conditions. When used for maintenance purposes, the airbag(s) will eliminate the use of a considerable volume of water that would otherwise be required to cause the barrier to deploy. Further, in the event the barrier deploys but there is leakage of water around the dam member 9, the airbag(s) can be used to provide additional lift to seal between the dam member 9 and the chamber 1. Subsequently, once the flood water has receded, the airbag(s) can be inflated to raise the dam member and allow cleaning of the barrier components to eliminate future leakage.

The ability to raise the dam member 9 at will makes the barrier particularly effective in sea defences because, once the airbag(s) have been deployed, raising and lowering of the dam member is then not affected by waves and the dam member remains effective until the airbag(s) are deflated. In addition, there is the possibility of a number of secondary uses for the barrier according to the present invention. For example, the dam member 9 can act as a security barrier preventing the passage of unauthorised vehicles (either operated manually or, for example, employing a swipe card or digital code to permit passage of an authorised vehicle). A further secondary use is as a fire break, especially when the dam member is coated with a fire-resistant resin. Another secondary use is to contain contaminated water in a certain location in order to prevent the contamination spreading.

The self-activating flood protection barrier according to the present invention shown in FIG. 7 comprises a hinged dam member 101 which is constructed to float on water and which, when not deployed, is stored in a shallow chamber 103, the dam member being hinged in the region of a side wall 105 of the chamber 103. The dam member 101 is connected to the ground in a watertight manner, for example by means of a waterproof membrane 107, to prevent the passage of flood water beneath the dam member. Interconnected tie straps 109, 111 are attached to both the dam member 101 and to the base of the chamber 103 to prevent the dam member pivoting substantially beyond an upright configuration. A grid 113 at the top of a second side wall 115 of the chamber 101 and serves as an inlet for flood water to cause the dam member 101 to raise. An outlet 117 allows the drainage and discharge of water from the chamber 101 to a remote area when required.

Positioned between the underside of the hinged dam member 101 and the base of the chamber 103 are one or more inflatable airbag(s) 119. A pump/compressor 121 positioned in the side wall 105 is connected to the airbag(s) 121 by an air transfer pipe 123 and serves to inflate the airbag(s) in order to raise the dam member and to allow it/them to deflate in order to allow the dam member to lower back into the chamber 101.

The barrier according to the present invention may be modified in a number of further ways. For example, the airbag(s) may alternatively be filled with a liquid to raise the dam member. This requires no substantial modification of the barrier compared with the use of air.

Figure 8:
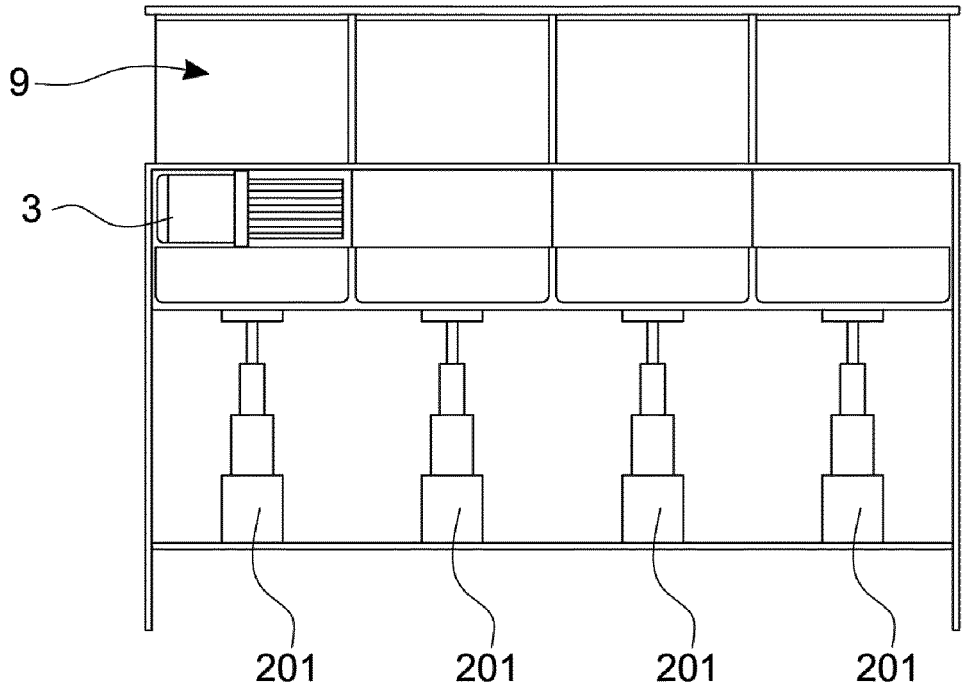
FIG. 8 is a front sectional view of a further alternative form of self-acting flood protection barrier according to the present invention.

Alternatively, the airbag(s) may be replaced by a pneumatic or hydraulic ram in the chamber 1 beneath the dam member 9 as shown in FIG. 8. The self-activating flood protection barrier shown in FIG. 8 is a modification of that shown in FIG. 5 in which a number of pneumatic or hydraulic rams 201 replace the airbags of FIG. 5 arranged beneath the dam member 9. In other respects the barrier of FIG. 8 is substantially the same as that of FIG. 5 and the corresponding figures and includes, for example, a pump/compressor 31 for extending and retracting the ram.

Figure 9:
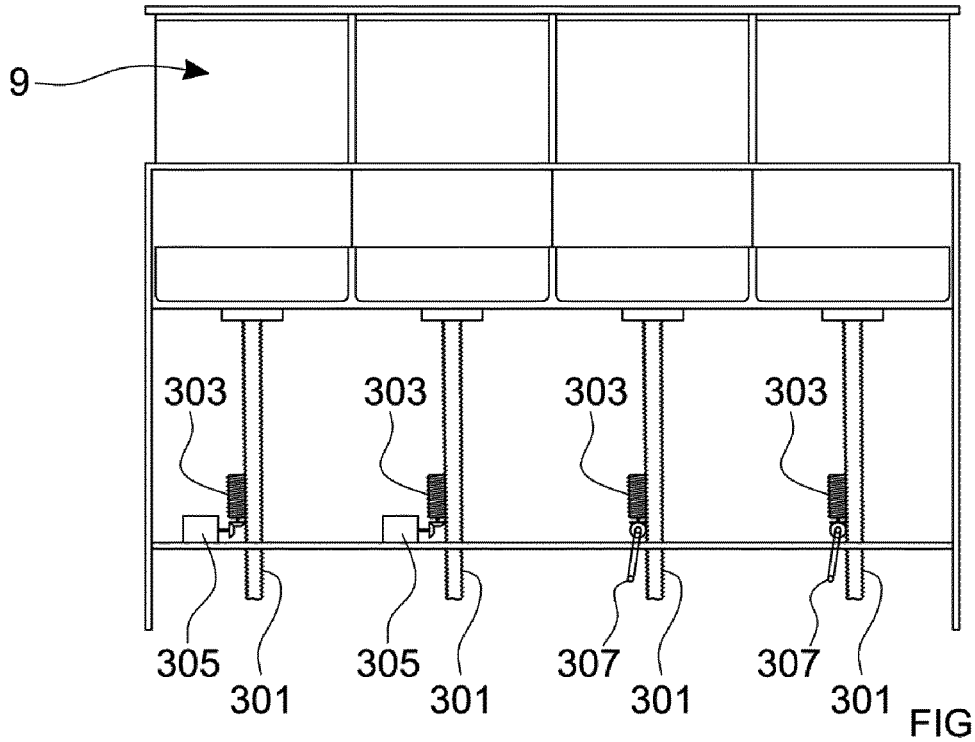
FIG. 9 is a front sectional view of another alternative form of self-acting flood protection barrier according to the present invention.

As a further alternative, the airbag(s) may be replaced by (electro)mechanical lifting means for the dam member 9 as shown in FIG. 9. The (electro)mechanical means is also located within the chamber 1 beneath the dam member 9, and illustrated in the left-hand part of FIG. 9 as an electromechanical lifting means in the form of an elongate threaded bar 301 which can be raised or lowered by a worm drive 303 which, in turn is driven by a submerged electric motor 305. Clearly other arrangements are possible. The (electro) mechanical means is illustrated in the right-hand part of FIG. 9 as a mechanical lifting means in the form of elongate threaded bar 301 which can be raised or lowered by worm drive 303 which, in turn, is rotated by a handle 307 which extends through the side of the barrier by way of a seal (not shown). Again, other arrangements are clearly possible.

The self-acting flood-protection barrier shown in FIGS. 10 to 17 is a modification of the barrier shown in FIGS. 1 to 6 and the same references are used to denote the same or similar components. That is, a chamber 1 is formed between a first side wall 3, a second side wall 5 and an inlet/outlet (not shown in FIGS. 10 to 17. A dam member 9 is arranged in the chamber 1 and is movable upwardly and downwardly dependent upon the level of water within the chamber 1. In the embodiment of FIGS. 10 to 17, the dam member 9 includes an upright wall 11 for preventing flow of water from a wet, or flooded, region into a dry region behind the barrier and two opposed inclined surfaces 13. Complementary inclined surfaces 15 are formed on support blocks 51 provided in an upper region of the chamber for engaging with each of the inclined surfaces 13, the support blocks 51 being described in more detail hereinafter. The inclined surfaces 13 cause the dam member 9 to narrow towards its upper end and the inclined surfaces of the support blocks 51 cause the width of the chamber to narrow such that the support blocks 51 and the inclined surfaces of the dam member engage when the dam member is deployed.

Figure 10:
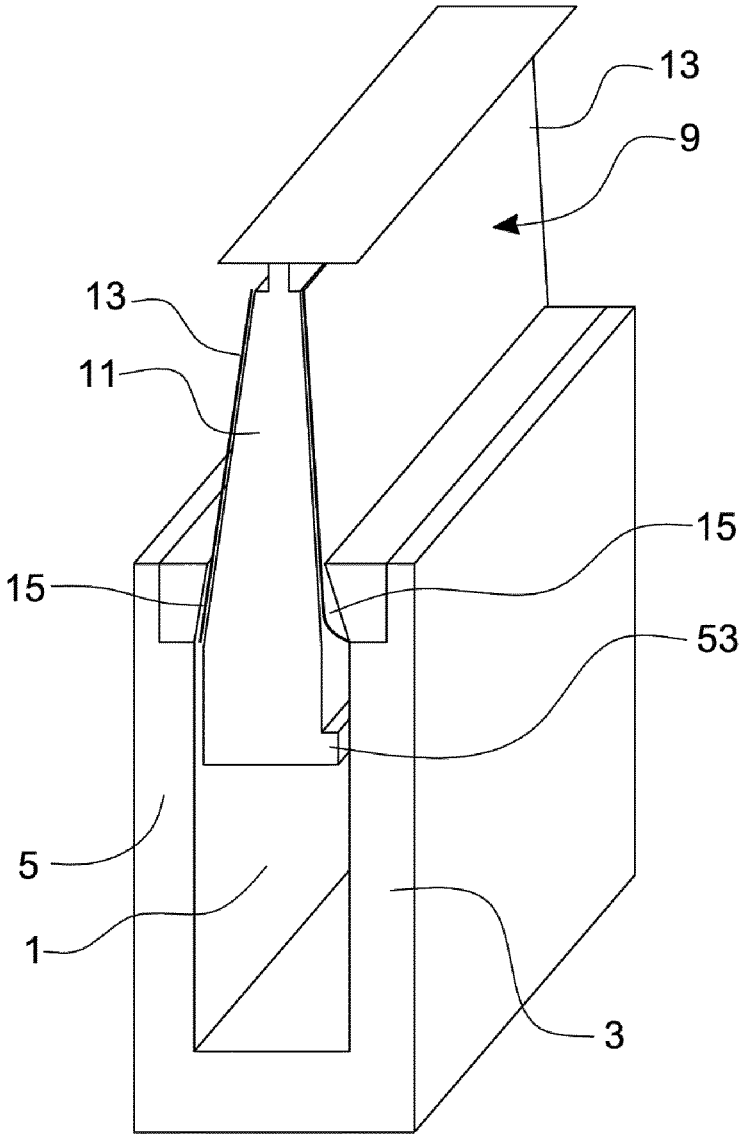
FIG. 10 is a perspective view of a further embodiment of a self-acting flood barrier according to the present invention, with a dam member in a raised configuration.
Figure 11:
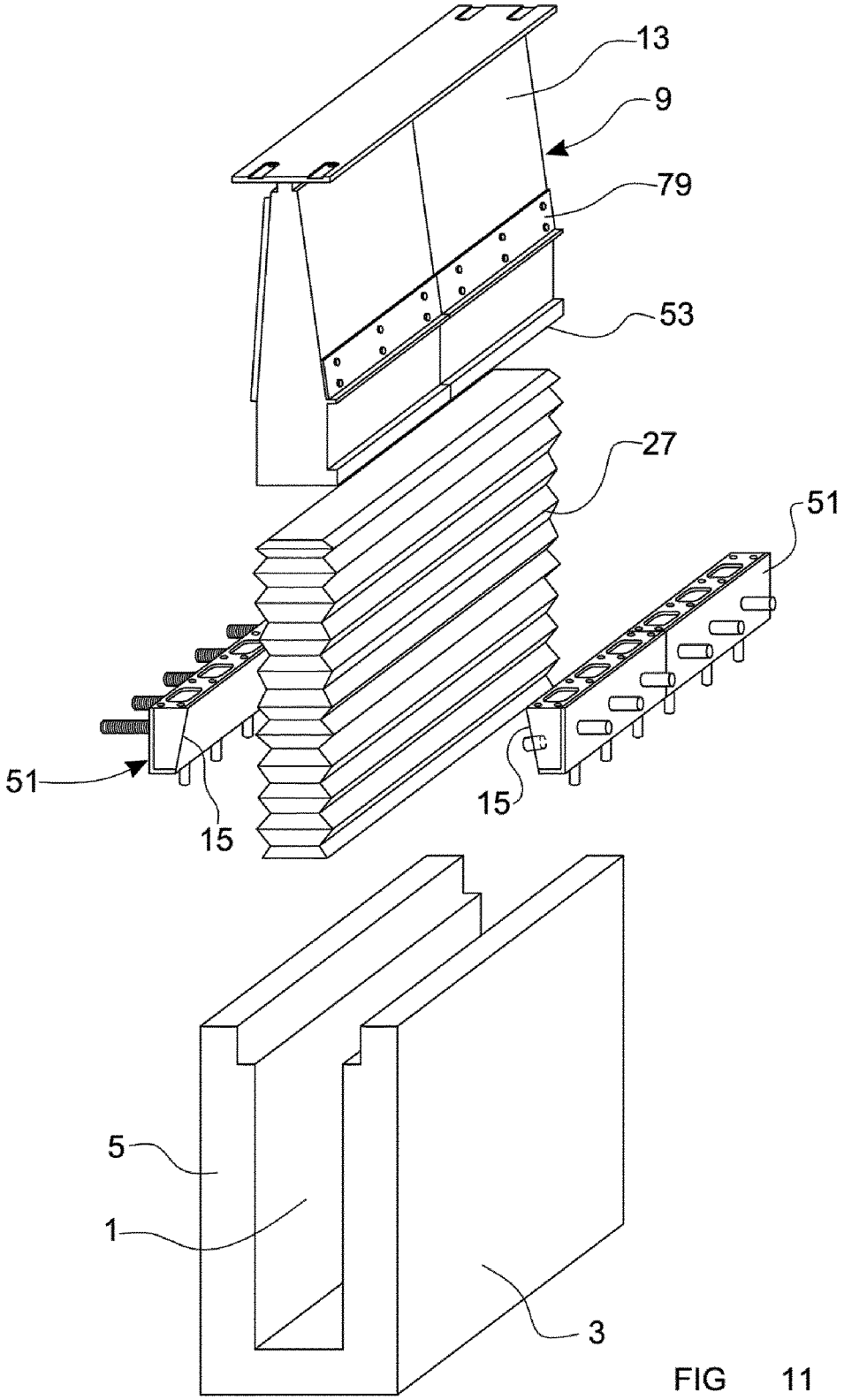
FIG. 11 is an exploded perspective view corresponding to FIG. 10 and showing an air bag positioned beneath the dam member.
Figure 12:
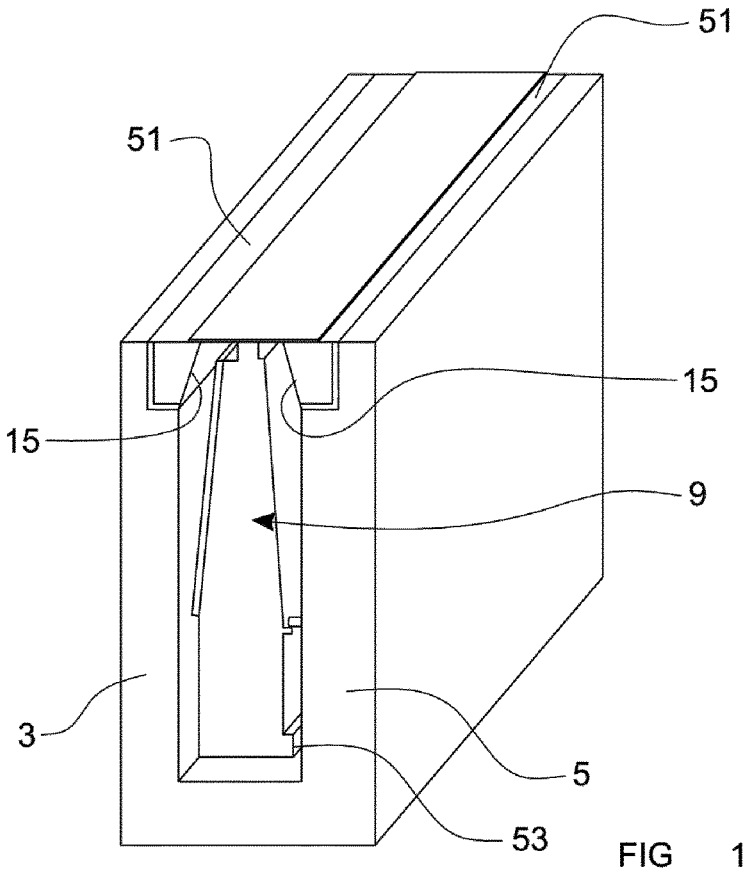
FIG. 12 is a perspective view corresponding to FIG. 10 with the dam member in a lowered configuration.

As can be seen from FIGS. 10 to 12, a longitudinally extending protrusion 53 (that is extending in the longitudinal direction of the dam member) is formed on one face of the dam member, in practice on the flooded side of the barrier, at or towards the lower end of the dam member. The protrusion 53 serves to distribute forces between the chamber wall and the dam member, which reduces localised stresses and spreads the load applied to the lower end of the dam member.

Especially where the chamber 1 is made of metal, the external faces of the chamber may be provided with reinforcing ribs as in FIGS. 1 to 6 and means is provided to secure adjacent chambers end-to-end in order to extend the length of the barrier.

The provision of one or more airbags 27 is shown in FIG. 11 with the operation of the airbag(s) being essentially the same as in FIGS. 1 to 6.

Figure 13:
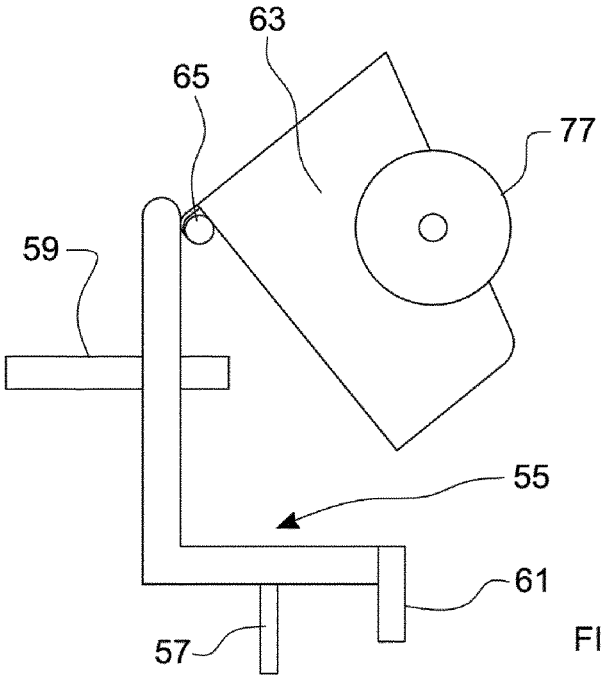
FIG. 13 is an end view of a support block for use in the present invention, the support block being in a first configuration.
Figure 14:
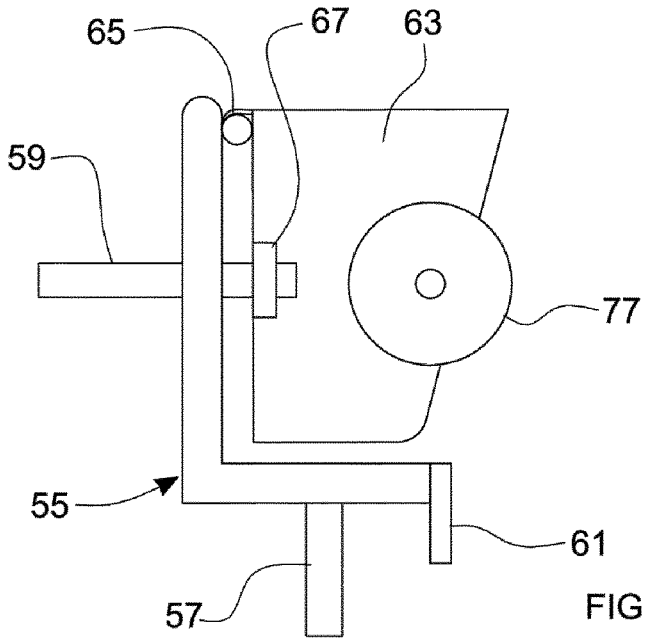
FIG. 14 corresponds to FIG. 13 with the support block in a second configuration.
Figure 15:
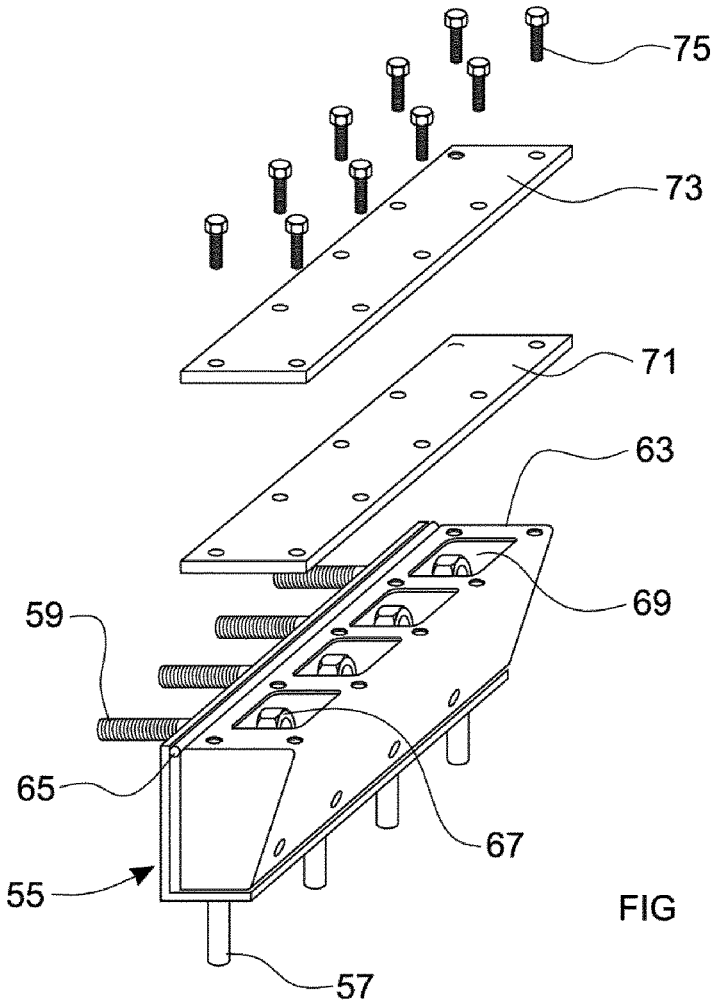
FIG. 15 shows an exploded view of the support block of FIGS. 13 and 14.
Figure 16:
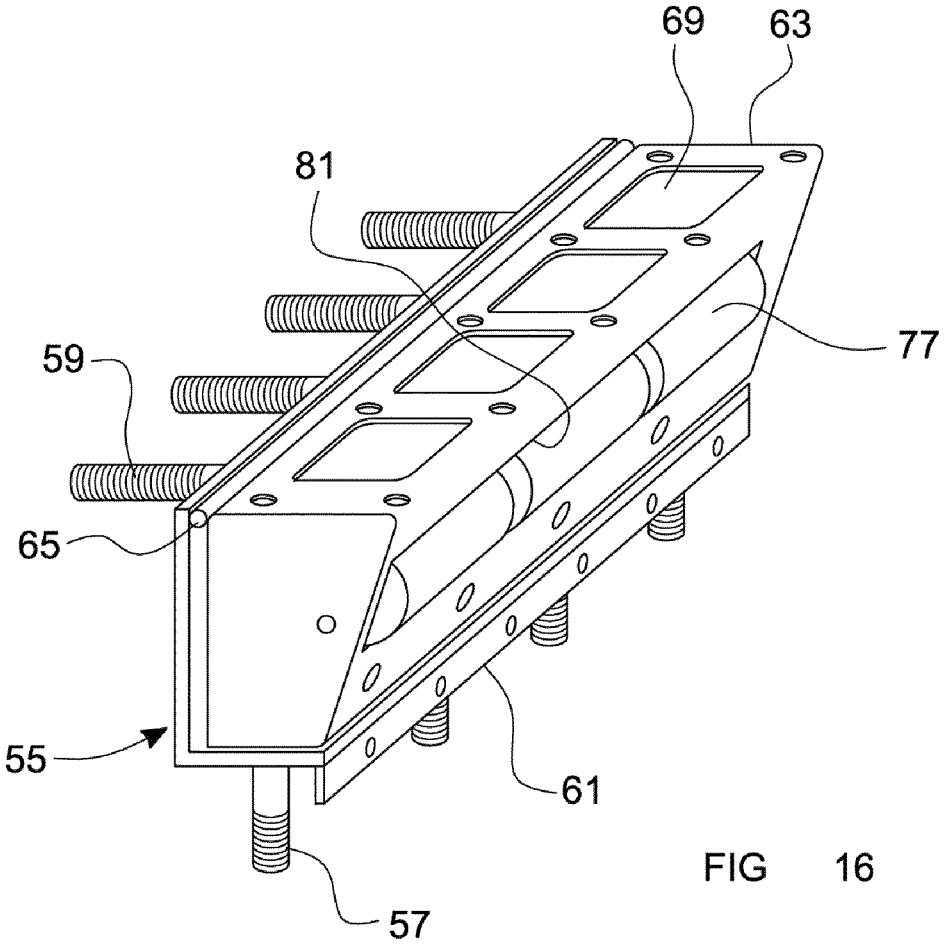
FIG. 16 shows the support block of FIGS. 13 to 15 incorporating a roller assembly.
Figure 17:
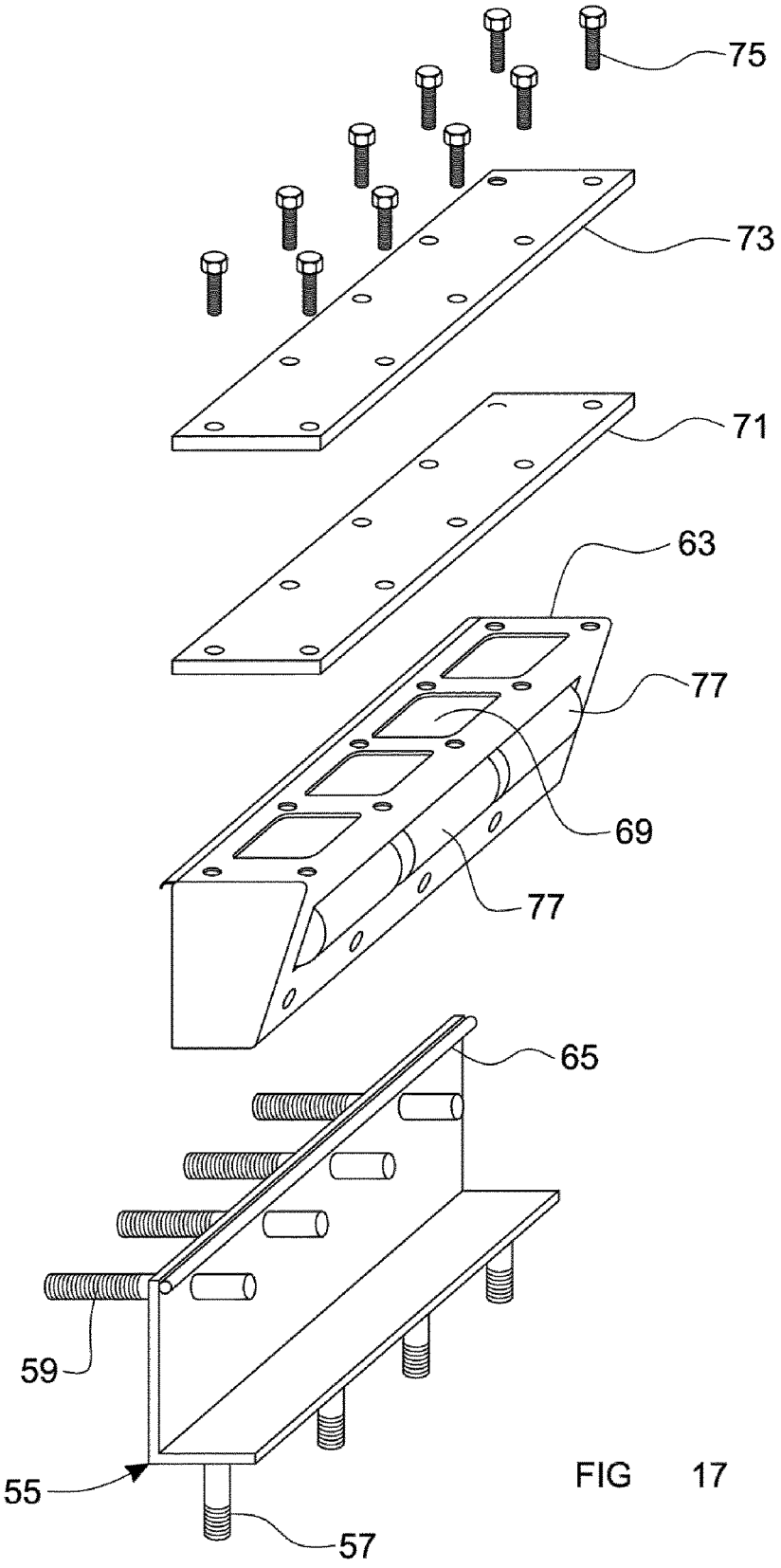
FIG. 17 shows an exploded view of the support block of FIG. 16.

The support blocks 51 are shown in more detail in FIGS. 13 to 15 and comprise in part a generally L-shaped bracket 55 which is secured in a complementary recess formed along the inner side of each upper edge of each of the side walls 3 and 5. The bracket is secured in place during manufacture of the chamber 1 by means of anchoring elements 57, 59 which extend into the concrete material of the side walls of the chamber. The anchoring elements may be in the form of a row of pegs 57 extending downwardly from the underside of the lower arm of the bracket 55 and a row of pegs 59 extending laterally from the upright arm of the bracket. The lateral pegs 59 additionally extend a short distance away from the concrete side wall 3, 5 and this part, at least of the pegs may be threaded to secure a further component of the support block 51 in position. The bracket 55 is optionally provided with a depending lip 61 at the free end of the lower arm of the bracket to protect the concrete surface of the side wall at this point. A further part of the support block 51 is a pivoting component 63 which provides the inclined surface 15 for engaging with the dam member. The pivoting component 63 is (preferably removably) hinged at 65 to an upper edge of the bracket 55, for example by means of a (removable) hinge pin or by way of interengaging formations on each of the pivoting component and the upper edge of the bracket which allow relative pivoting of the pivoting component to the bracket. Thus, when the pivoting component 63 is pivoted downwardly to be received in the L-shaped bracket 55 the inclined surface causes the upper portion of the chamber 1 to narrow, but when the pivoting component is removed, or pivoted upwardly away from the L-shaped bracket, the upper portion of the chamber is not narrowed and the dam member can be lowered into the chamber or raised out of the chamber.

In the event the side walls of the chamber 1 are made from metal, the L-shaped bracket can be formed directly in the side walls and only a separate pivoting component 63 is required for the support block.

When the pivoting component is pivoted downwardly to be received in the L-shaped bracket, the free ends of the anchoring elements 59 pass through a wall of the pivoting component and the pivoting component can be releasably secured in place by nuts 67. Access to the threaded ends of the anchoring elements 59 is by way of apertures 69 provided in an upper surface of the pivoting component 63, the apertures being closed in use of the barrier by a seal 71 and a top plate 73 which is held in place by removable threaded fasteners 75.

As explained above, prior to the installation of the pivoting component 63, the inner faces of the side walls 3 and 5 are planar and substantially parallel. In the absence of the pivoting component it is therefore possible to insert the dam member 9 into the chamber 1 on-site rather than during manufacture of the chamber. This greatly simplifies both manufacture of the chamber and installation of the barrier because the chamber can be manufactured separately and installed on site before the dam member 9 is lowered into the chamber and retained within the chamber as a result of subsequent installation of the pivoting components 63. It also permits removal and replacement of a dam member if required, for example to access an airbag beneath the dam member.

Jamming of the dam member 9 against the side walls 3, 5 of the chamber 1 is prevented by the provision of a low friction device 77, 79, at least on that side of the dam member exposed to the flood water and arranged between the side of the dam member and the side wall of the chamber, as shown in more detail in FIGS. 11, 13, 14, 16 and 17. A further low friction device may be mounted on that side of the dam member not exposed to the flood water if desired and arranged between the side of the dam member and the side wall of the chamber, but the type of low friction device needs to be selected to ensure an effective seal between the dam member and the side wall of the chamber on the dry side so in general no low friction device is provided on the dry side. In addition to preventing jamming of the dam member, the low friction device(s) also allows for smoother movement of the dam member relative to the side walls of the chamber 1. Two forms of low friction device are shown in FIGS. 10 to 17, but as an alternative either low friction device may be employed without the other.

Low friction device 77, shown in FIGS. 13, 14, 16 and 17, comprises a roller assembly mounted within the pivoting component 63 (or, alternatively, mounted in the inclined surface 15 if there is no pivoting member) such that a part of cylindrical surface of a roller of the assembly protrudes through an aperture 81 formed in the inclined surface such that the roller engages with the inclined surface 13 of the dam member. The roller is rotatable about an axis extending in the longitudinal direction of the dam member. In practice a number of roller assemblies may be provided along the longitudinal direction of the dam member. The ability of the roller to rotate prevents jamming of the dam member in the upper region of the chamber and allows the dam member to retract as the flood water recedes. Low friction device 77 could alternatively be positioned in the dam member to engage with the inclined surface 15 of the side wall of the chamber.

Low friction device 79, shown in FIG. 11, comprises a coating of low friction material (such as a fluoropolymer (e.g., PTFE) with or without nickel, graphite or molybdenum disulphide, or molybdenum disulphide with or without further components) or, as illustrated, a plate provided with a coating of a low friction material. The plate 79 is extends in the longitudinal direction of the dam member so as to contact the inclined surface 15 of the side wall of the chamber 1, but alternatively could be provided on the side wall 15 to engage with the inclined surface 13 of the dam member.

The invention claimed is:

1. A self-activating flood barrier including a chamber (1) having first and second side walls (3, 5), a dam member (9) adapted to self-deploy in the event of a flood to inhibit the passage of water to a region to be protected, and a low-friction device (77, 79) positioned between the dam member and at least one of the first and second side walls of the chamber when the dam member is deployed so as to prevent jamming between the dam member and the at least one side wall, wherein at least one side wall (13) of the dam member (9) is inclined such that the dam member is narrower in an upper region thereof compared with a lower region thereof and wherein a complementary inclined surface (15) is provided on a support block (17, 51), the support block including a pivoting component (63) pivotably mounted to the side wall (3, 5) of the chamber (1) and positioned at an upper region of the corresponding side wall (3, 5) of the chamber (1) so as to engage with the inclined side wall of the dam member when the dam member is deployed, and a secondary deployment means including at least one inflatable air bag (27) disposed beneath the dam member (9).

2. A self-activating flood barrier as claimed in claim 1, wherein the low-friction device (77, 79) is arranged between that side of the dam member (9) and the one of the first and second side walls (3) of the chamber (1) exposed to flood water.

3. A self-activating flood barrier as claimed in claim 1, wherein the pivoting component (63) is mounted by way of a hinge (65).

4. A self-activating flood barrier as claimed in claim 1, wherein the pivoting component (63) is separable from the remainder of the barrier.

5. A self-activating flood barrier as claimed in claim 1, and including nuts (67) for releasably securing the pivoting component (63) against pivoting.

6. A self-activating flood barrier as claimed in claim 5, wherein the pivoting component (63) is hollow and the nuts (67) is are located within the pivoting component, the pivoting component being provided with at least one aperture (69) for accessing the releasable securing means.

7. A self-activating flood barrier as claimed in claim 6, wherein the pivoting component (63) includes a removable seal (71) and cover plate (73) for closing the at least one aperture (69).

8. A self-activating flood barrier as claimed in claim 1, wherein the pivoting component (63) is mounted on the side wall (3, 5) by way of an L-shaped bracket (55) set into the side wall of the chamber (1).

9. A self-activating flood barrier as claimed in claim 8, wherein the L-shaped bracket (55) is provided with anchoring elements (57, 59) for anchoring the bracket to the side wall (3, 5) of the chamber (1).

10. A self-activating flood barrier as claimed in claim 8, wherein the L-shaped bracket (55) is provided with a depending lip (61) to protect the surface of the side wall (3, 5) of the chamber (1).

11. A self-activating flood barrier as claimed in claim 1, wherein the dam member (9) is provided in a lower region of that side of the dam member exposed to flood water is formed with a longitudinal protrusion (53) to engage against the side wall (3) of the chamber (1).

12. A self-activating flood bather as claimed in claim 1, wherein the secondary deployment means (27, 201, 301) is capable of deploying the dam member independent of any flood condition.

13. A self-activating flood barrier as claimed in claim 12, and including sensor means to determine whether or not the dam member (9) has self-deployed in the event of a flood and to deploy the secondary deployment means (27, 201, 301) in the event the dam member has failed to self-deploy.

14. A self-activating flood barrier as claimed in claim 1, wherein the at least one inflatable air bag (27) is supported on an inverted tray (25) to allow debris to accumulate beneath the tray.

15. A self-activating flood barrier as claimed in claim 1 and including a pump/compressor (31) for passing air to/from the at least one inflatable air bag (27), the pump/compressor (31) being provided within a watertight chamber (32).

16. A self-activating flood barrier as claimed in claim 15, wherein the watertight chamber (32) is provided in use in an upper region of the barrier.

17. A self-activating flood barrier as claimed in claim 1, wherein the dam member (9) is provided with a recess (35) in a lower surface thereof.

18. A self-activating flood barrier as claimed in claim 17, wherein the recess (35) is in the form of an inverted V.

19. A self-activating flood barrier as claimed in claim 17, wherein the recess (35) is part-circular in cross-section.

* * * * *